United States Patent [19]

Kruse

[11] 4,322,905

[45] Apr. 6, 1982

[54] PORTABLE DISPLAY UNIT

[76] Inventor: Robert A. Kruse, 11108 Abbott La., Minnetonka, Minn. 55343

[21] Appl. No.: 125,224

[22] Filed: Feb. 27, 1980

[51] Int. Cl.[3] ..... G09F 15/00; G09F 7/02; A47B 95/02; A47B 97/04

[52] U.S. Cl. ..... 40/606; 40/611; 40/615; 40/610; 190/1; 312/254; 312/244; 248/450; 248/460

[58] Field of Search ..... 40/606, 607, 610, 611, 40/615, 571, 572, 573, 574, 575, 152.1, 155; 190/1, 42; 312/197, 254, 244; 248/441 A, 450, 460, 461

[56] References Cited

U.S. PATENT DOCUMENTS

| | | | |
|---|---|---|---|
| 1,127,223 | 2/1915 | Fogle | 40/606 |
| 1,884,971 | 10/1932 | Galbraith | 40/611 |
| 2,105,008 | 1/1938 | Riley | 40/615 X |
| 2,515,313 | 7/1950 | Pember | 40/606 |
| 2,602,252 | 7/1952 | Shinn | 40/610 |
| 2,844,897 | 7/1958 | Vance | 40/610 |
| 3,174,629 | 3/1965 | Gelberg et al. | 211/199 |
| 3,297,118 | 1/1967 | Van Skyhawk et al. | 312/244 |
| 3,314,180 | 4/1967 | Porter | 40/615 X |
| 3,402,491 | 9/1968 | Wagner | 40/573 X |
| 3,514,173 | 5/1970 | Ford | 248/461 X |
| 3,596,387 | 8/1971 | Hoeve | 40/611 X |
| 3,637,172 | 1/1972 | Diesbach | 248/460 |
| 3,947,986 | 4/1976 | Page | 40/572 X |
| 3,965,599 | 6/1976 | Ebner | 40/152 |
| 4,019,271 | 4/1977 | Latimer | 40/612 X |
| 4,081,119 | 3/1978 | Messmore | 40/610 X |

*Primary Examiner*—Gene Mancene
*Assistant Examiner*—Michael J. Foycik
*Attorney, Agent, or Firm*—L. Paul Burd; Richard O. Bartz; Robert W. Gutenkauf

[57] ABSTRACT

A portable display unit for display of advertising material or other informational or decorative material on changeable display cards and for storage of other display cards. The display unit includes a rectangular box-like housing convertible between a collapsed or closed and portable configuration and an erect or a display configuration supported on a stand. At least one wall of the housing is comprised as a removable panel to expose a picture type frame surrounding a viewing area to be filled by the display card to be viewed. A retractable handle is provided for transport of the unit from place to place in the collapsed or closed configuration.

55 Claims, 25 Drawing Figures

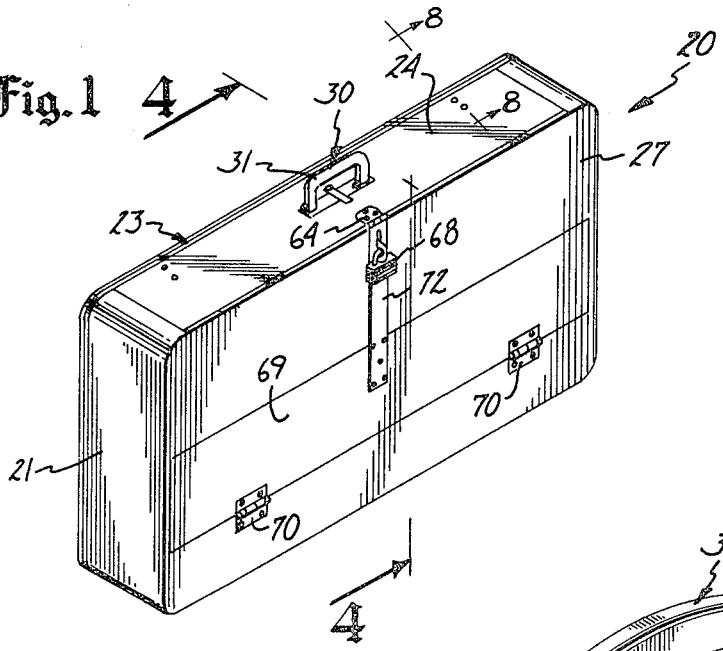
Fig. 1
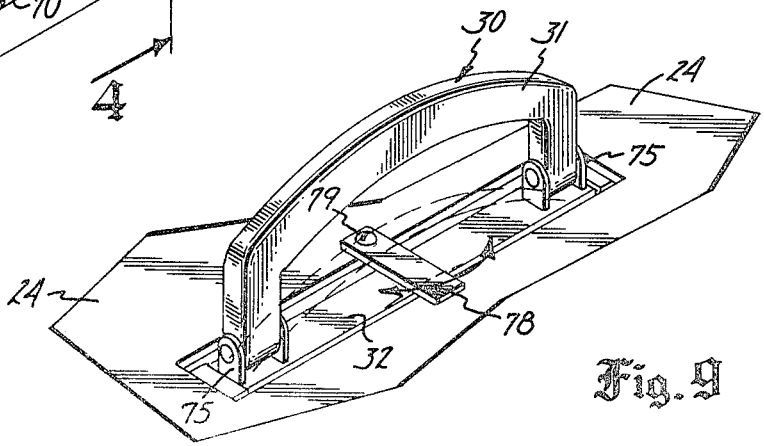
Fig. 9
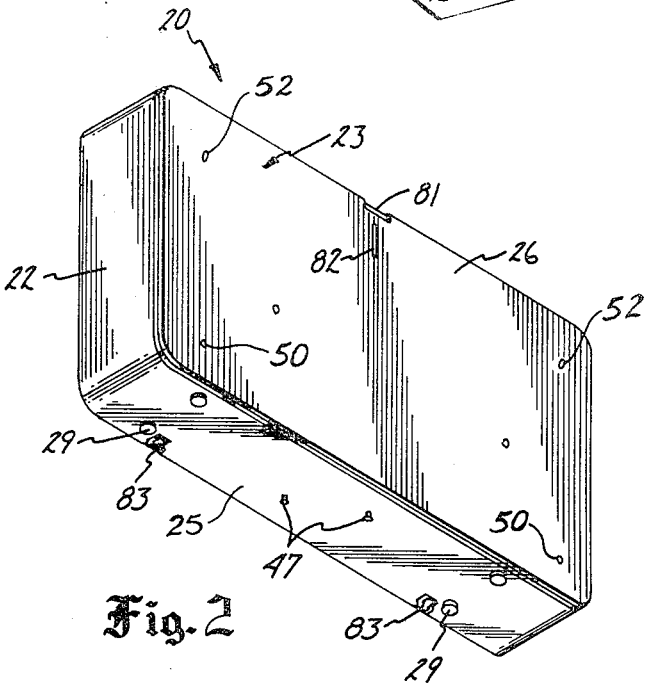
Fig. 2
Fig. 14
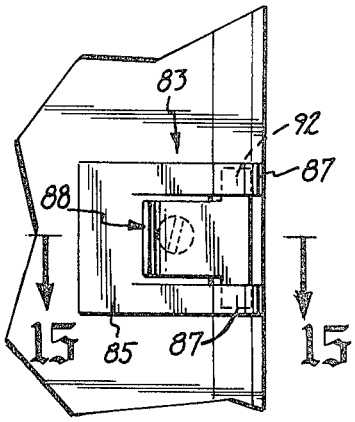

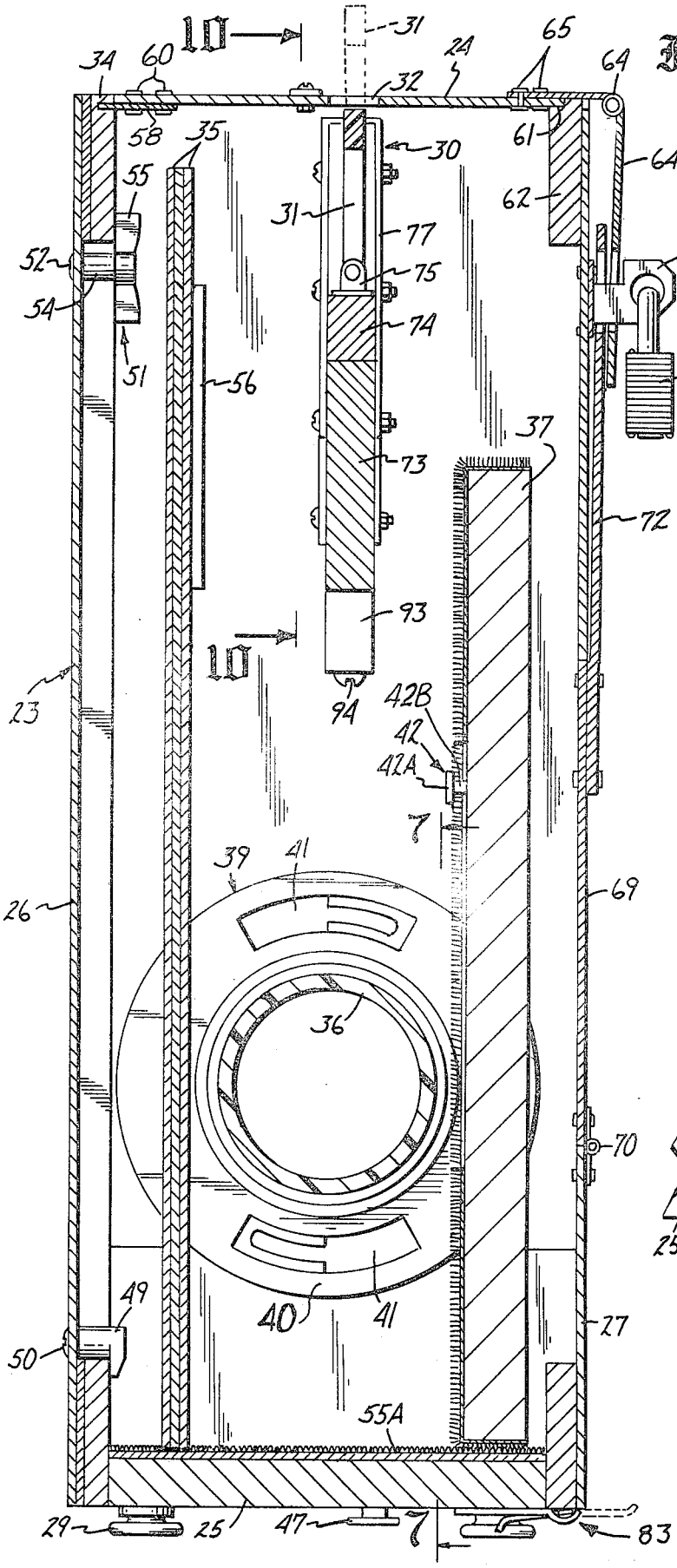
Fig.4
Fig.8
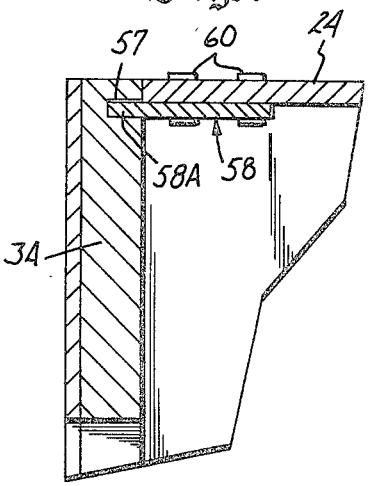
Fig.15
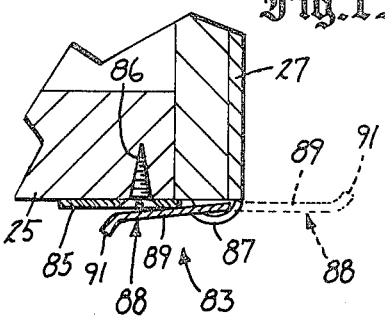

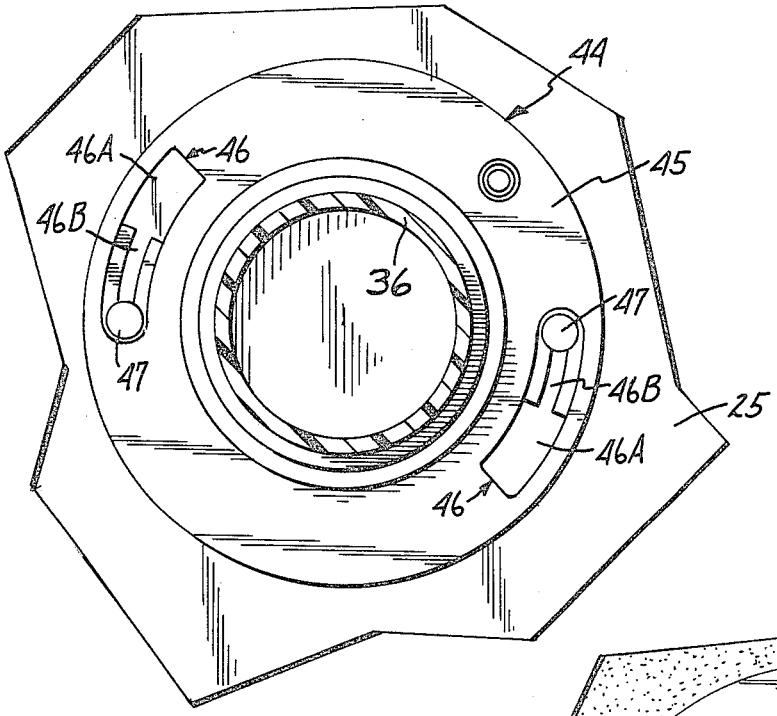
Fig. 5
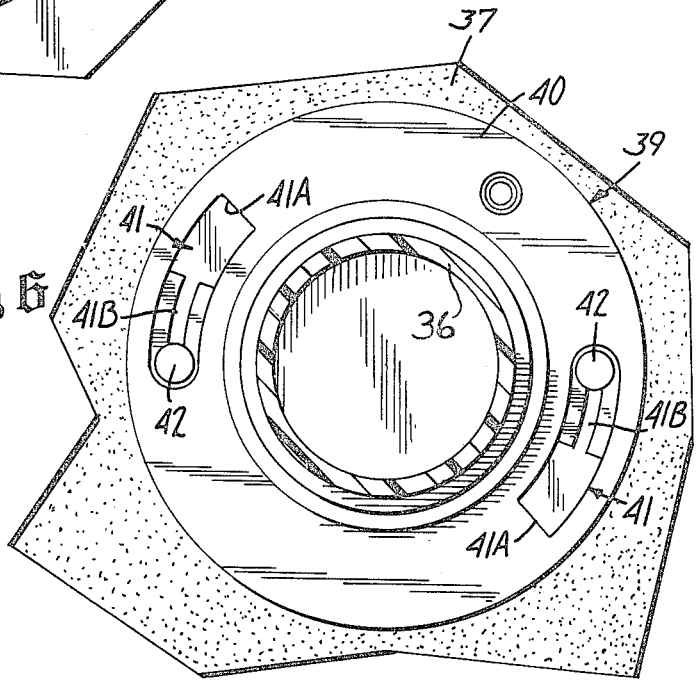
Fig 6
Fig. 7
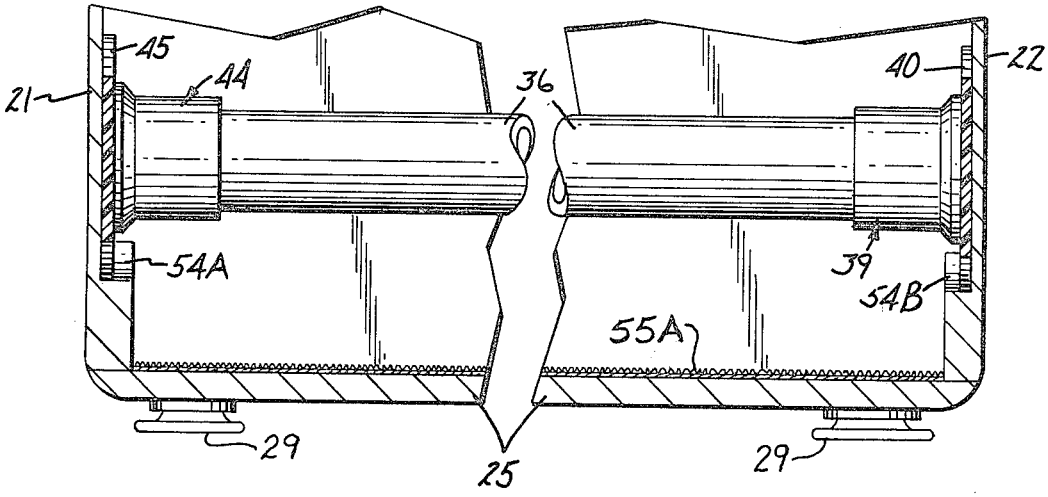

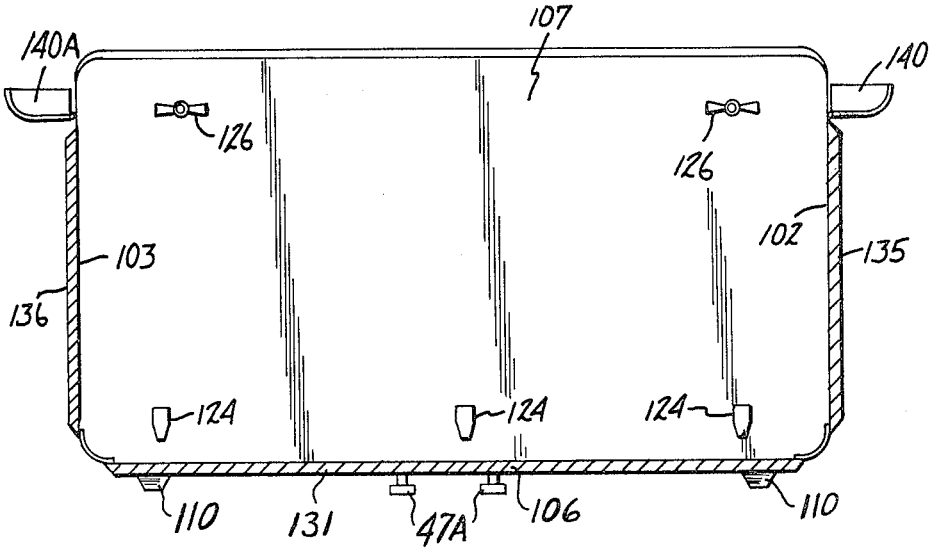
Fig.23
Fig.25
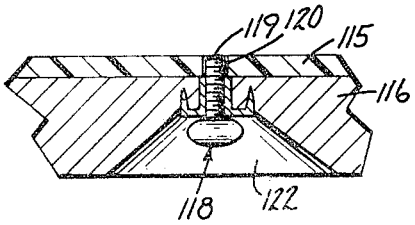
Fig.24
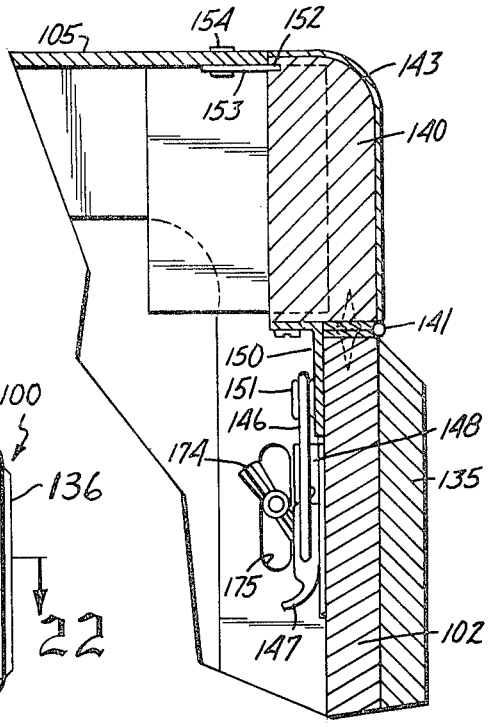
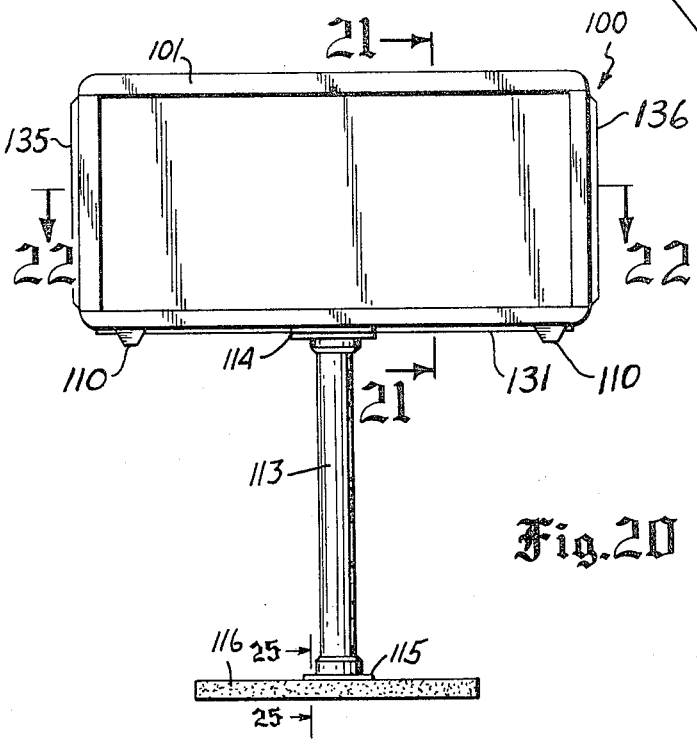
Fig.20

PORTABLE DISPLAY UNIT

BACKGROUND OF THE INVENTION

There is frequently a need for a portable display device that can be carried from place to place for presenting an unattended display or for making a presentation. Such devices can be used to carry advertising, notices, art work, or other informational material. Collapsible easels can be and are used for this purpose. However, among other shortcomings, these are not readily portable, do not provide for storage of excess or extra display cards, and are not as aesthetically pleasing as might be desired. The display cards are not held as securely as would be desirable.

The invention pertains to a portable display unit usable to display advertisements, notices, posters, art work, and other informative material contained on interchangeable display cards. The display unit includes a rectangular box-like housing convertible between a collapsed or closed configuration readily portable from place to place, and a display or erected configuration supported on a stand. In the collapsed configuration, the housing contains a column and base of a stand as well as a plurality of display cards. A wall of the frame is comprised as a removable panel which is removed in the display configuration to expose a picture type frame surrounding a viewing area. The viewing area is filled by one of the interchangeable display cards. The unit can be left unattended with a single display card in sight, or the display cards are readily interchangeable as during the giving of a presentation. A carrying handle is retractable into the housing when not in use. In the display configuration of one form of the invention, the removable wall is stored behind the housing adjacent a back wall. A top wall of the unit is removable for access to the display cards contained in the frame. In a modification of the invention, both the front and rear walls are removable to expose viewing areas to be filled by display cards. The front and rear walls are storable in the housing.

IN THE DRAWINGS

FIG. 1 is a perspective view of a portable display unit of the invention in the collapsed configuration showing the rear and top sides thereof;

FIG. 2 is a perspective view of a portable display unit of FIG. 1 showing the front and bottom sides thereof;

FIG. 4 is an enlarged sectional view of the portable display unit of FIG. 1 taken along the line 4—4 thereof;

FIG. 5 is an enlarged sectional view of a portion of the portable display unit shown in FIG. 3 taken along the line 5—5 thereof;

FIG. 6 is an enlarged sectional view of a portion of the portable display unit of FIG. 3 taken along the line 6—6 thereof;

FIG. 7 is a reduced sectional view of a portion of the portable display unit as shown in FIG. 4 taken along the line 7—7 thereof and support column shown in side elevation;

FIG. 8 is an enlarged sectional view taken along the line 8—8 of FIG. 1 of a corner portion of the portable display unit;

FIG. 9 is an enlarged view of the handle portion of the portable display unit shown in FIG. 1;

FIG. 14 is an enlarged fragmentary view of a portion of the lower wall of the portable display unit as shown in FIG. 2 showing a retaining clip in a retracted position; and FIG. 15 is a sectional view of the fragmentary portion of a portable display unit of FIG. 14 taken along the line 15—15 thereof;

FIG. 20 is a front elevational view of the portable display unit of FIG. 16 shown in the erected or display configuration;

FIG. 23 is a reduced sectional view of the portable display unit of FIG. 21 taken along the line 23—23 thereof;

FIG. 24 is an enlarged fragmentary view of a portion of the corner of a portable display unit of FIG. 23; and FIG. 25 is an enlarged sectional view of a portion of the portable display unit of FIG. 20 taken along the line 25—25 thereof.

DESCRIPTION OF A PREFERRED EMBODIMENT

Figure 3:
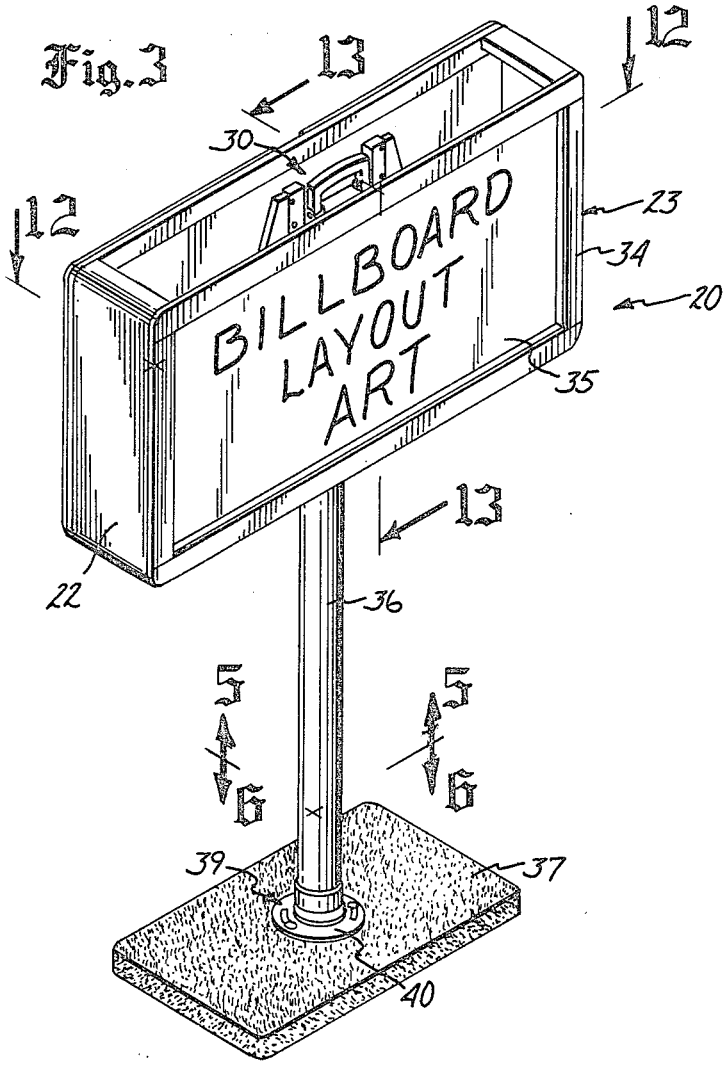
FIG. 3 is a perspective view of the portable display unit of FIG. 1 in the assembled or display configuration.
Figure 11:
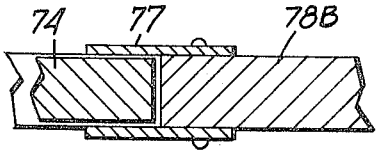
FIG. 11 is an enlarged fragmentary sectional view of the portion of the portable display unit shown in FIG. 10 taken on the line 11—11 thereof.

Referring to the drawings, there is shown in FIGS. 1 and 2 a portable display unit of the invention indicated generally at 20 in a collapsed and portable configuration. Display unit 20 includes a rectangular box-like cabinet or housing 23 comprised of side walls 21, 22, top wall 24, bottom wall 25, front wall 26, and a rear wall 27 assembled in a closed configuration. A plurality of feet 29 are fastened to the bottom wall 25 in order to support the display unit 20 on a surface such as a floor. A handle assembly 30 includes a handle grip 31 extendable through an opening 32 in top wall 24 in order that the display unit 20 can be carried from place to place.

Display unit 20 is shown in the erected or display configuration in FIG. 3. Front wall 26 of display unit 20 is comprised as a removable panel, removed as shown in FIG. 3 to expose a picture type display frame 34 circumscribing the forward edges of side walls 21, 22 and top and bottom walls 24, 25 to define a viewing area filled by a display card 35 mounted in the housing of display unit 20. Display card 35 can carry advertising material, notices, art work, and the like.

Housing 23 is mounted on a stand comprised as an upright tubular column 36 and a flat base 37 that can be covered with a decorative carpet or the like. Column 36 is releasably connected to base 37 by a bayonet type coupling including an end collar 39 secured to the lower end of column 36 and having an annular peripheral flange 40. As shown in FIG. 6, flange 40 has a pair of symmetric arcuate keyholes 41. Each keyhole 41 has enlarged eyelet 41A intersected by a narrower keyway 41B. A pair of headed members 42, as screws or bolts, are secured to base 37. Each member 42 has an enlarged head 42A and a narrower shank 42B extended into base 37 (see FIG. 4). Headed members 42 are sized and orientated to be inserted through the eyelets 41A of keyholes 41. After being so inserted, column 36 is twisted so that shanks 42B of headed members 42 are engaged in keyways 41B with heads 42A of members 42 holding flange 40 to the base 37. In similar fashion, a second collar 44 is secured to the upper end of column 36 and has an outwardly extended annular peripheral flange 45 (see FIG. 5). Flange 45 has a pair of arcuate, symmetric keyholes 46 having enlarged eyelet portions 46A intersected by narrower keyways 46B. A pair of headed members 47 are fixed to the bottom wall 25 of the housing 23 and have enlarged heads with narrower shanks extended into the bottom wall 25. Headed members 47 are sized and orientated to be inserted through the eyelets 46A of keyholes 46. When so inserted, column 36 is twisted to the extent that the shanks of headed members 47 are engaged in the keyways 46B of keyholes 46. The headed members 47 thus secure the flange 45 with respect to the bottom wall 25. The collars 39 and 44 can be identical so as to be interchangeable. Releasable lock means, as bolts threaded in base 37, can be used to retain collars 39 and 44 in assembled relation with base 37 and bottom wall 25 of housing 23. An example of a releasable lock bolt for retaining the column to the base is shown in FIG. 25 and hereinafter described.

Base 37 and column 36 are readily disassembled from one another and, as shown in FIG. 4, are stored in housing 23 when display unit 20 is in the collapsed configuration. In the closed or collapsed configuration of FIG. 4, removable front panel or wall 26 is installed in covering relationship with respect to display frame 34 to close the viewing area defined by display frame 34. A plurality of L-shaped hook-like members 49 are fastened to the interior surface of the front wall 26 as by screws 50 toward a lower portion thereof and are downwardly orientated to engage the upper edge of the lower horizontal member of display frame 34. A plurality of fasteners 51 are secured to the interior surface of front wall 26 toward the upper portion thereof for engagement with the lower edge of the upper horizontal member of display frame 34. As shown, a fastener 51 includes a bolt 52 with a head located on the exterior surface of front wall 26. The shank of the bolt passes through front wall 26 and a spacer 54, and engages a wing nut 55. The arms of wing nut 55 are rotatable into and out of engagement with the interior surface of frame 34 opposite front wall 26 for securing and removal of front wall 26 with respect to frame 34.

Column 36 and base 37 are stored in housing 23 when the display unit is in the collapsed configuration. As shown in FIG. 7, edge portions of the flanges 40, 45 of the collars 39, 44 are accommodated by slots formed adjacent the side walls 21, 22 by upstanding blocks 54A and 54B. Column 36 spans the length of housing 23. Base 37 is situated on carpeting or other soft surface 55A located on the interior surface of bottom wall 25. Base 37 is disposed between the column 36 and back wall 27. Extra display cards 35 are stored in housing 20 on the opposite side of column 36 relative to base 37. A pair of outstanding ears 56 are provided inwardly extended from the side walls 21, 22 (see FIG. 4). The edges of the display cards 35 are held between outstanding ears 56 and the interior surfaces of frame 34.

Top wall 24 is removable for the purpose of interchanging display cards 35 and to put in and take out base 37. As shown in FIG. 8, frame 34 has an interior horizontal groove 57 extending substantially the length of the upper member of frame 34. A band 58 is fastened by suitable fasteners 60 to the lower forward edge of top wall 24 and has a lip 58A extending forwardly of the front edge of top wall 24. The lip 58A is engaged in groove 57 of frame 34. The opposite or rearward edge of top wall 24 rests in a notch 61 formed along the upper inner corner of an upper horizontal support member 62 secured along the upper edge of back wall 27. Top wall 24 is held in place by a hasp assembly including a hinged strap 64 with a fixed end secured to the rear edge of top wall 24 by suitable fasteners 65. A pivotal end 64A of hinged strap 64 engages a staple or hasp eye 66 secured to the back wall 27. A padlock 68 engaged in hasp eye 66 prevents disengagement of the pivoting or free end 64A of hinged strap 64. In removal of top wall 24, with the padlock 68 disengaged, the pivoting end 64A of hinged strap 64 is pivoted upwardly and lifted such that top wall 24 is removed as the lip 58A of band 58 becomes disengaged from the groove 57 in the frame 34.

Back wall 27 is equipped with a door 69 as shown in FIGS. 1 and 4 for entry and removal of column 36 from the interior of housing 23. Door 69 is comprised as a cut-out portion of back wall 27 connected by hinges 70 at its lower edge to back wall 27 for pivoting about a horizontal axis proximate its lower edge to be opened and closed. A second strap 72 is fixed to the door 69 and orientated to engage or straddle the hasp eye 66 when door 69 is rotated to a closed position and to be maintained in such position by the padlock 68.

Figure 10:
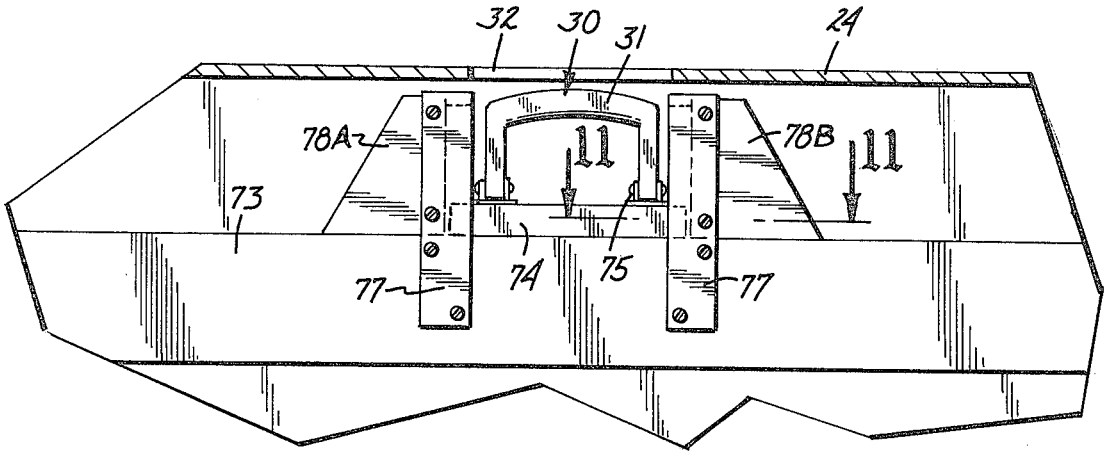
FIG. 10 is a reduced fragmentary sectional view of a portion of the portable display unit shown in FIG. 4 taken along the line 10—10 thereof.

A cross beam 73 extends lengthwise centrally through the interior of housing 23 being interiorly connected to side walls 21, 22. Handle assembly 30 is connected to the midsection of cross beam 73. Handle grip 31 is rotatably mounted to a transverse handle block 74 by upwardly standing lug members 75. In the retracted orientation, handle block 74 rests on cross beam 73 as shown in FIG. 10. Inverted U-shaped guides 77 are mounted to cross beam 73 in straddling relationship to the ends of handle block 74 which extend beyond handle grip 31. Guides 77 are assembled to cross beam 73 by suitable screws or the like. Additional support blocks 78A and 78B can also be provided to further support the guides 77 with respect to the cross beam 73. Handle block 74 is upwardly movable with the handle grip 31 and is constrained and guided by the legs of the inverted U-shaped guides 77. Upward movement of handle block 74 is limited by the top horizontal portion of the guides 77. As shown in FIG. 9, handle grip 31 is movable up through the opening 32 in top wall 24. When handle grip 31 is in the upwardly projected position, a retaining finger 78 pivotally mounted to the top wall 24 by a screw 79 is rotatably movable to a position in spanning relationship to the opening 32 to prevent total retraction of handle grip 31. This is for convenience as when the display unit is in the collapsed configuration being transported and is momentarily set down. In the display configuration, handle grip 31 is fully retracted so as to be out of view from the outside.

Figure 13:
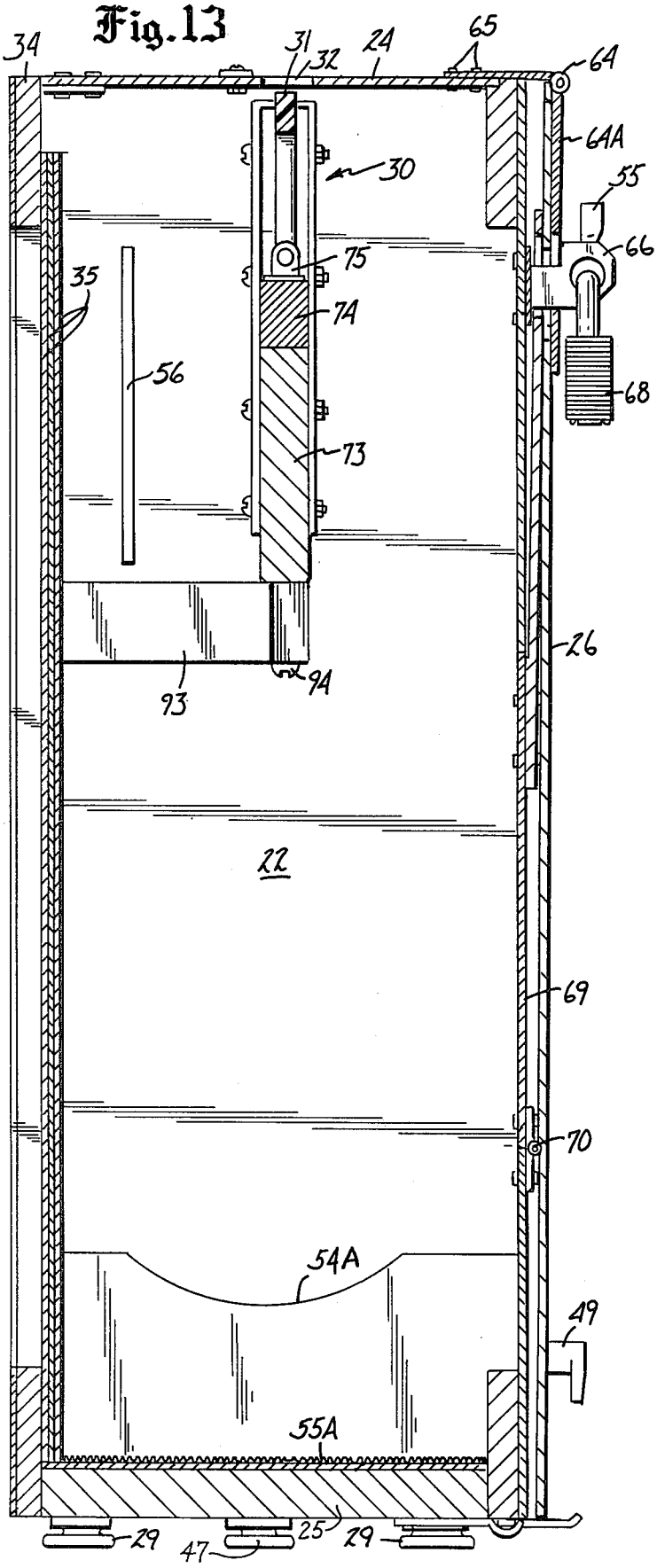
FIG. 13 is an enlarged sectional view of a portion of the portable display unit shown in FIG. 3 taken along the line 13—13 thereof.
Figure 12:
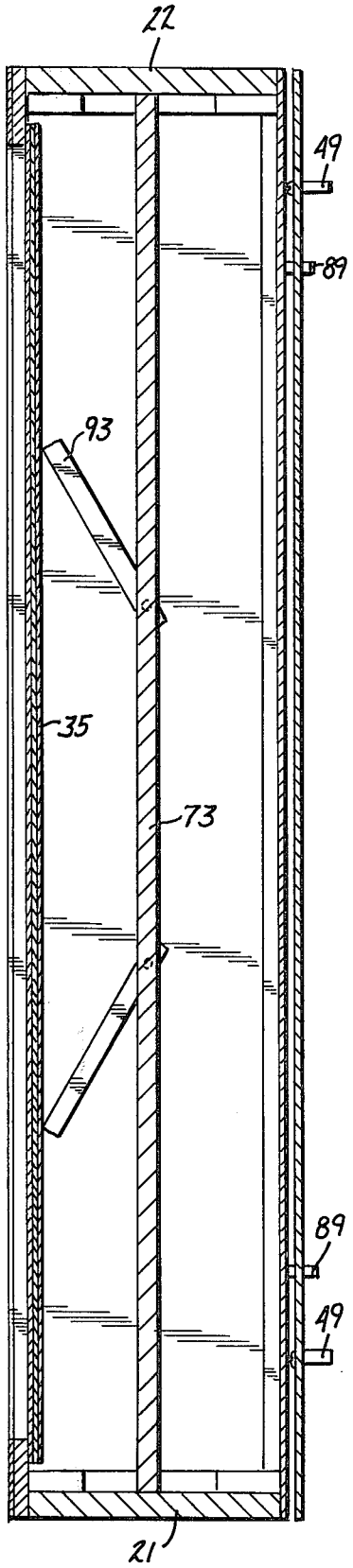
FIG. 12 is an enlarged sectional view of the portable display unit shown in FIG. 3 taken along the line 12—12 thereof.

In the display configuration of display unit 20, as shown in FIGS. 3, 12, and 13, the removable front panel comprising front wall 26 is removed and is stored adjacent back wall 27. As shown in FIG. 2, front wall 26 has a horizontal slot 81 and a vertical slot 82. When stored on the back wall 27, the free or pivotal end 64A of the hinged strap 64 is inserted through the horizontal slot 81 of front wall 26. Also, in the display configuration, top wall 24 can be removed from the top of housing 23 to be also stored adjacent the back wall 27 by hanging with the pivotal end 64A of strap 64 in engagement with hasp eye 66.

Support means for front wall 26 when stored adjacent the back wall 28 comprises a pair of support clips 83 to support the lower edge of front wall 26. As shown in FIGS. 14 and 15, each support clip 83 includes a flat base 85 fixed to bottom wall 25 near the rear edge thereof by a suitable screw 86. A pair of semi-round resilient spring elements 87 extend from base 85 and have free ends in contact with the rear edge of bottom wall 25. A movable T-shaped support member 88 has a flat body 89 terminating in an outwardly directed lip 91. At the opposite end of the support member 88 are outwardly directed arms 92 assembled in the resilient spring elements 87. Resilient spring elements 87 form an over-center spring clip which tends to keep the support element 88 in either the retracted out of the way position as shown in full lines in FIG. 15, or in the outwardly extended support position as shown in phantom in FIG. 15. The support member 88 is rotatably moved against the bias of the spring elements 87 between positions. In the outwardly extended position, the support member supports the lower edge of front wall 26 as it is stored adjacent back wall 27.

As shown in FIGS. 12 and 13, when in the display configuration, means for holding display cards 35 in place with respect to the viewing space defined by frame 34 comprise a pair of pivoting arms 93. Pivoting arms 93 are pivotally connected to the lower edge of cross beam 73 as by bolts 94 which frictionally restrain the arms 93 to a degree that they remain in the desired position. As shown, arms 93 are rotated to a position where they contact the rear surfaces of display cards 35. The display cards 35 are held in position between arms 93 on one side and the interior edges of frame 34 on the other. With the top wall 24 removed, access to the interior of housing 23 permits adjustment of the position of the arms 93 as well as the interchangeability of the display cards 35.

A second form of display unit according to the invention is shown in FIGS. 16 through 25 wherein a two-sided display can be presented. A portable display unit is indicated generally at 100 in FIGS. 16 and 17 in the closed or collapsed and portable configuration. Display unit 100 has a rectangular box-like cabinet or housing 101 comprised of sidewalls 102, 103, a top wall 105, a bottom wall 106, a front wall 107 and a rear wall 109. A plurality of feet 110 are fastened to bottom wall 106 in order to support the display unit 100 on a surface such as a floor. A handle assembly 111 is provided for carrying the display unit 100 from place to place.

Figure 16:
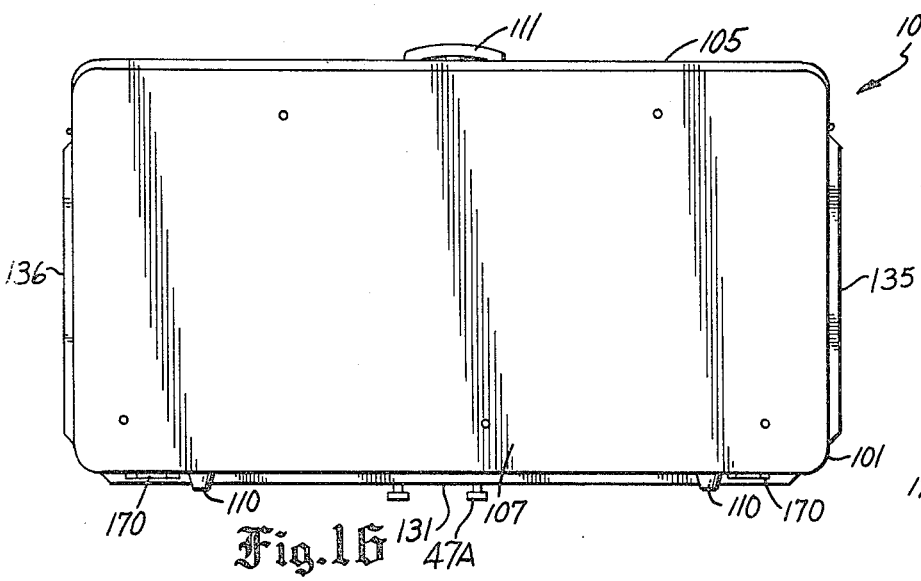
FIG. 16 is a front elevational view of a portable display unit according to a second form of the invention.
Figure 17:
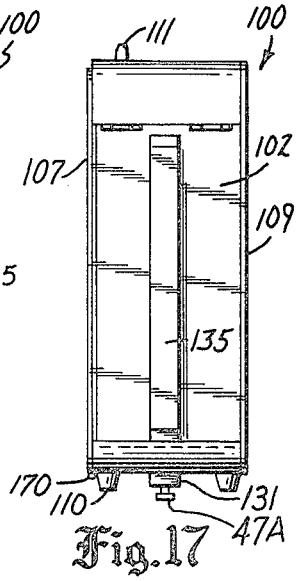
FIG. 17 is an end elevational view of the portable display unit of FIG. 16.

Display unit 100 is readily convertible between the closed or collapsed configuration of FIG. 16 to the erect or display configuration of FIG. 20. In the erect configuration of FIG. 20, housing 101 is supported by a stand comprising an upright tubular column 113 with upper and lower flanged end collars 114, 115. Lower end collar 115 is removably assembled to a flat base 116, while upper end collar 114 is removably assembled to the bottom wall 116 of housing 101. The end collars 114, 115 can be assembled by means of bayonet mounting assemblies as previously described. The bayonet mounting assemblies include headed members 47A attached to strip 131 and a pair of slots in the collar 114. The collars 114 and 115 can have additional locking assemblies in order to prevent unwanted disassembly of the unit. For example, as shown in FIG. 25, a thumb screw 118 having a threaded shank 119 is threaded into a threaded opening 120 extending through a portion of flange 115 and the lower surface base 116. Thumb screw 118 is located at an upwardly dished-in portion 122 on the lower surface of base 116. After the column 113 has been assembled to the base of 116, the thumb screw 118 is inserted and threaded into the opening 120 to prevent undesired disengagement of the column 113 from the base of 116. Similar fastening means can be provided between the upper flanged collar 114 and the bottom wall 106 of housing 101.

Figure 18:
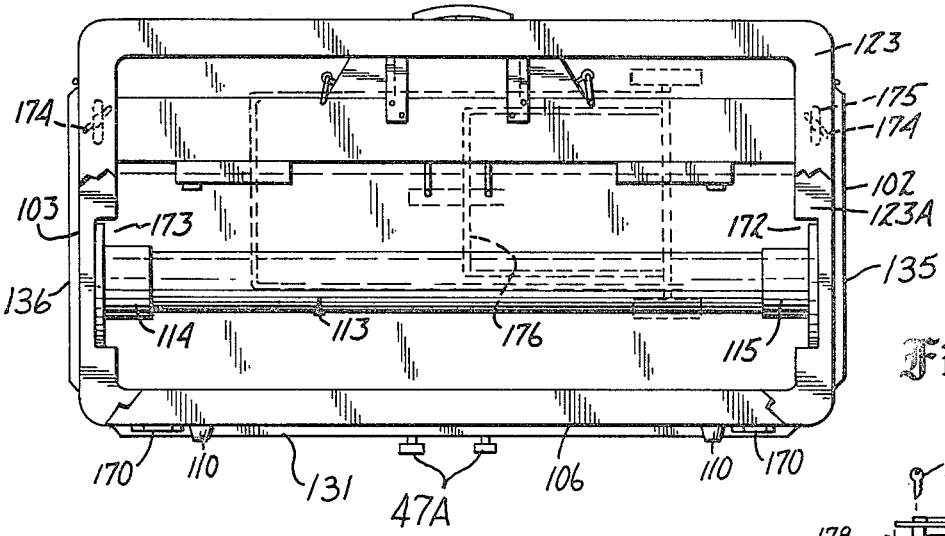
FIG. 18 is a front elevational view of the portable display unit of FIG. 16 with portions broken away for purposes of illustration.

Front wall 107 of display unit 100 is comprised as a removable panel, removed as shown in FIG. 18 to expose a picture type display frame 123 defining a viewing area that can be filled by a display card mounted in housing 101. Frame 123 is assembled to the forward edges of sidewalls 102, 103 and of bottom wall 106. A plurality of L-shaped hook-like members 124 are fastened to the interior surface of front wall 107 toward the lower portion thereof and are downwardly orientated to engage the upper edge of the lower horizontal member of frame 123. A plurality of wing-type fasteners 126 are secured to the interior surface of front wall 107 toward the upper portion thereof positioned for engagement with the lower edge of the upper horizontal member of frame 123. When hook members 124 are in engagement with the lower horizontal member of frame 123 and wing fasteners 126 are turned to engage the inner face 123A of frame 123, the front wall 107 is fixed with respect to the remainder of housing 101. Front wall 107 is removed simply by rotation of wing members 126 to an orientation out of engagement with the lower edge of the upper horizontal member of frame 123.

Rear wall 109 is also comprised as a removable panel extending substantially the length of housing 101, removable to expose a rear picture type display frame 127 defining a viewing area that can be filled by a display card situated within housing 101. The plurality of L-shaped hook-like members 128 are fastened to the interior surface of rear wall 109 toward the lower portion thereof and are downwardly orientated to engage the upper edge of the lower horizontal member of rear frame 127. A plurality of wing-type fasteners 129 are secured to the interior surface of rear wall 109 toward the upper portion thereof for engagement with the lower edge of the upper horizontal member of rear frame 127. The rear wall 109 can be assembled and removed from housing 101 with respect to rear frame member 127 in a fashion similar to that of replacing and removing the front wall 107 with respect to the front frame 123.

Figure 21:
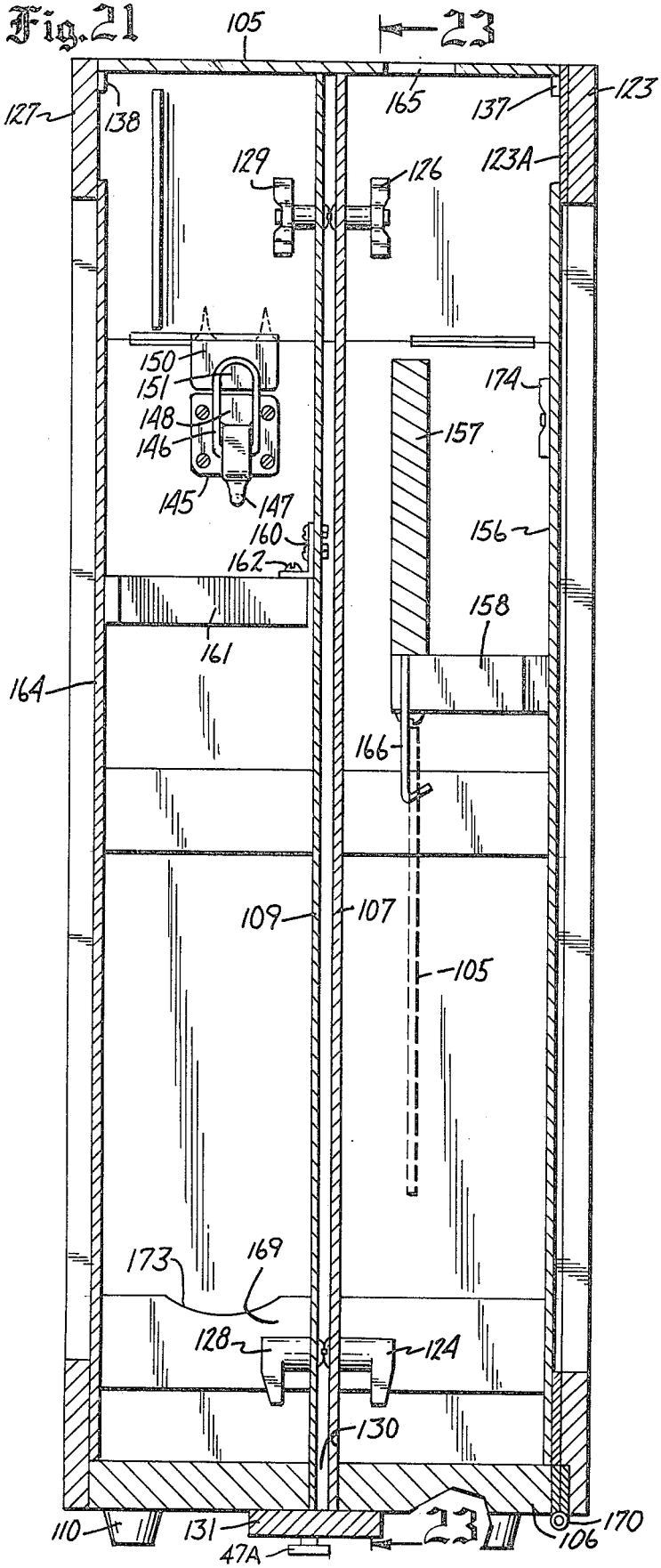
FIG. 21 is an enlarged sectional view of a portion of the portable display unit of FIG. 20 taken along the line 21—21 thereof.

Means are provided for storage of front and rear walls 107, 109 within housing 101 when display unit 100 is in the erect configuration. As shown in FIG. 21, bottom wall 106 of housing 101 has an interior, central, longitudinal groove 130 extended the length thereof. The lower edges of front and rear walls 107, 109 rest in groove 130. The surfaces of front and rear walls 107, 109 that are exterior when the display unit 100 is in the closed configuration are in facing relationship, and the hook-like members 124, 128 and wing-type fasteners 126, 129 of the front and rear walls respectively extend away from one another. For the purpose of providing sufficient vertical distance for storage of walls 107, 109, groove 130 is comprised as a separation or opening extended through the width of bottom wall 106 and closed exteriorly by a longitudinal rib 131. Rib 131 is fastened to the exterior of bottom wall 106 in covering relationship to the edges of opening 130 as by glue or other suitable means.

Figure 22:
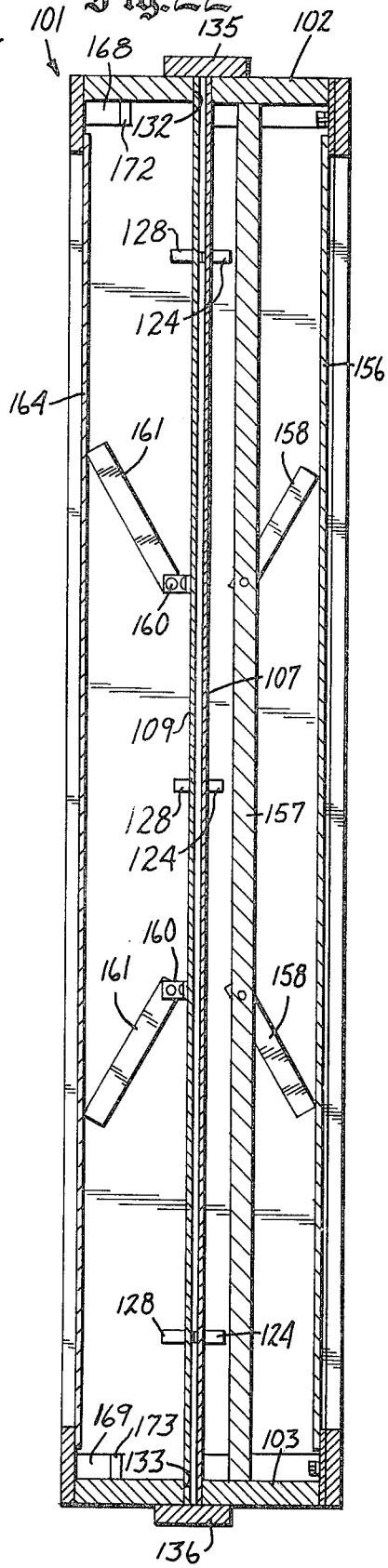
FIG. 22 is an enlarged sectional view of the portable display unit of FIG. 20 taken along the line 22—22 thereof.

As shown in FIG. 22, the sidewalls 102, 103 of housing 101 are provided with interior vertical grooves 132, 133 respectively, coplanar with horizontal groove 130. The lateral edges of walls 107 and 109 are accomodated in the vertical grooves 132, 133. For the purpose of providing sufficient longitudinal distance for storage of the walls 107, 108 in housing 101, the grooves 132, 133 are formed as a separation or opening extended through the respective sidewalls 102, 103 and closed exteriorly by vertical ribs 135, 136. The ribs 135, 136 are fastened to the respective sidewalls 102, 103 in covering relationship to the exterior edges of the openings 132, 133 by suitable means such as glue.

Top wall 105 is removable to permit access to the interior of housing 101. As shown in FIG. 21, first horizontal support strut 137 is fixed to the interior edge of the upper member of front frame 123 recessed slightly below the upper edge thereof. A second horizontal support strut 138 is fixed to the interior side of the upper horizontal member of rear frame 127 recessed slightly below the upper edge thereof. As shown in FIG. 21, the longitudinal edges of top wall 105 rest on the first and second support struts 137, 138 such said the top surface of top wall 105 is flush with the upper edges of front and rear frames 123, 127.

Referring to FIGS. 24 and 25, sidewall 102 has a pivoting top section comprised as a pivoting block 140. Block 140 is pivotally connected to the lower section of sidewall 102 by a hinge 141 whereby it can be outwardly pivoted as shown in FIG. 23. Block 140 has a central groove 142 in alignment with the groove 132 in the lower section of sidewall 102 for accomodation of the upper lateral edges of front and rear walls 107, 109 when stored in housing 101. Block 140 has a covering 143 which covers the upper portion of groove 142 when the block is in the closed position of FIG. 24 thus to close the housing 101. Block 140 is pivotal to the outer position shown in FIG. 23 in order that the front and rear walls 107, 109 may be inserted and removed from the housing 101. Latch means are provided to hold the block 140 in the closed position shown in FIG. 24. As shown in FIGS. 24 and 21, a luggage type latch assembly includes a base 145 fixed to the interior surface of sidewall 102 beneath the block 140. A buckle assembly including a closed buckle loop 146 is positionally controlled by an over-center latch lever 147 that coacts with a stop member 148. An L-shaped plate 150 carries a catch 151 engageable by an end of buckle loop 146 in the locked position shown in FIGS. 24 and 21. Pivotal movement of lever 147 away from sidewall 102 is effective to release loop 146 from catch member 151 and permit pivoting of the block 140.

Block 140 has a pair of interiorly facing horizontal slots 152 near the upper edge thereof. Corresponding ears 153 attached by rivets 154 near the edge of top wall 105 are insertable into the slots 152 when top wall 105 is in the closed position to help maintain top wall 105 in position. Rotation of block 140 disengages the ears 153 from the slots 152.

Referring to FIG. 23, second sidewall 103 has a pivoting top section comprised as a second pivoting block 140A. The second pivoting block 140A is constructed in identical fashion to the first pivoting block 140. When both of the pivoting blocks 140, 140A are outwardly pivoted as shown in FIG. 23, front and rear walls 107, 109 can be inserted and removed from within housing 101.

With front and rear walls 107, 109 removed, display cards can be exhibited in the viewing areas defined by front and rear display frames 123, 127. As shown in FIGS. 21 and 22, a first display card 156 fills the viewing area defined by front frame 123. A cross beam 157 extends the length of housing 101 and is secured at its ends to the side walls 102, 103. A pair of pivoting holding arms 158 are pivotally connected to the lower edge of cross beam 157 and are frictionally restrained to a degree that they remain in the desired position bearing against the rear side of display card 156 to hold display card 156 in position with respect to the viewing area defined by front frame 123 with the periferal edges of the display card 156 abutting against the interior edges of frame 123.

The surface of rear wall 109 facing the rear frame 127 carries a pair of L-shaped brackets 160 which carry a second pair of pivoting holding arms 161. The arms 161 are frictionally, pivotally assembled to the horizontal legs of the L-shaped brackets 160 by suitable means such as screws 162. The arms 161 are frictionally restrained but are pivotal such that they will remain substantially in the angular position in which they are placed. The arms 161 bear against the rear surface of a second display panel 164 spanning the viewing area defined by rear frame 127 and having periferal edges in contact with the interior edges of rear frame 127. If desired, extra display cards can be stored behind the first and second display cards 156, 164.

Cross beam 157 can carry handle assembly 111 as previously described for inward and outward movement through an opening 165 located in top wall 105 as shown in FIG. 21. Cross beam 157 can also carry hooks 166 for storing top wall 105 (as shown in phantom in FIG. 21) when the unit is in the display configuration to prevent ready access to the interior housing for placement and interchanging of display cards.

Figure 19:
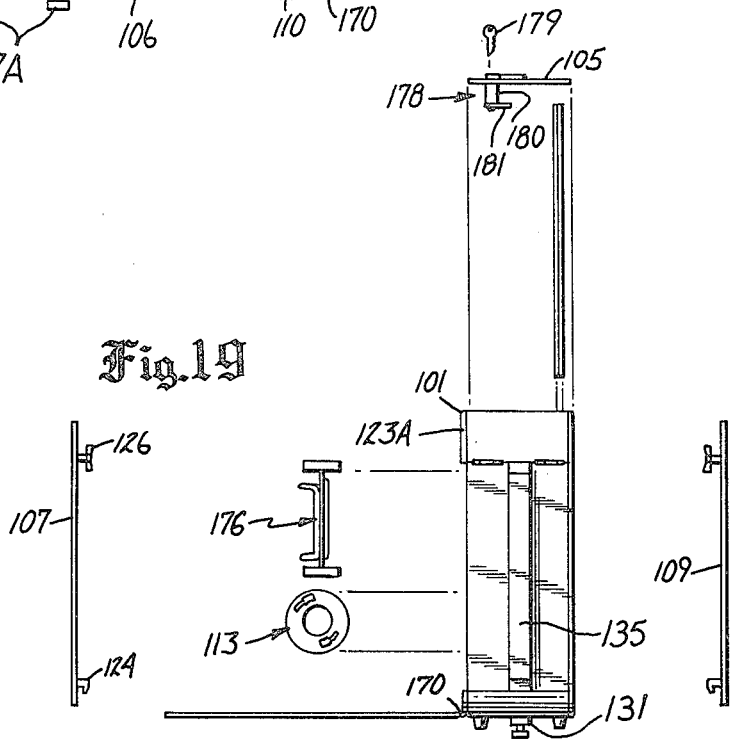
FIG. 19 is a reduced assembly view of the portable display unit of FIG. 16.

As shown in FIG. 18 and in the assembly drawing of FIG. 19, the support column 113, base 116 and display cards are stored in housing 101 when in the collapsed or closed configuration. Column 113 can be of a length substantially equal to the interior lengthwise dimensions of housing 101. When stored in housing 101, the flanges of the collars 114, 115 of column 113 rest between upper and lower end blocks 168, 169 (see FIG. 21) situated on interior surfaces of each of the sidewalls 102, 103. In order for insertion and removal of column 113 from the interior of housing 101, front frame 123 is pivoted at its lower edges by hinges 170 to the forward edge of bottom wall 106. As shown in FIG. 19, the front frame 123 can be pivoted away from the housing 101 to expose a subframe 123A. Subframe 123A is secured to sidewalls 102, 103 and bottom wall 106. Subframe 123A substantially corresponds in shape and conforms to frame 123 except for notched sections 172, 173 on the vertical side members thereof as shown in FIG. 18. Notched sections 172, 173 are located to provide clearance for the end flanges of the collars 114, 115 of column 113.

Means are provided to secure frame 123 adjacent subframe 123A. A pair of twist type fasteners 174 having outwardly extending legs are centrally, pivotally connected to the vertical members of frame 123 toward the upper end thereof. Subframe 123A has corresponding elongated openings 175. Frame 123 is pivoted into position with respect to subframe 123 with the twist type fasteners 174 passing through the openings 175. The fasteners 174 are then twisted such that the legs bear against the interior surfaces of subframe 123A to hold frame 123 in position.

A portable collapsable luggage carrier 176 can also be stored in the housing 101 depending from hooks (not shown) secured to cross beam 157. Luggage carrier 176 can be used to transport the portable display unit from place to place when in the collapsed configuration.

Means are provided for locking the housing in the closed configuration. As shown in FIG. 19, a lock assembly 178 is installed on top wall 105 and includes a lock casing 180 with a horizontal finger 181 turnable by manipulation of a key 179. The horizontal finger 181 can be turned to a position beneath the lower edge of frame 123 and frame 123A when the front and rear walls 107, 109 are in covering relationship to the sides of the housing such that the top wall 105 cannot be removed and unauthorized access into the interior of housing 101 cannot be gained.

The embodiments of the invention in which an exclusive property or privilege is claimed are defined as follows:

1. A portable display unit convertible between a portable collapsed configuration and a display configuration for exhibition of at least one display card, comprising: a housing having a first display opening for exhibition of a display card located in the housing when said unit is in the display configuration, said housing having a first removable top wall for access into the interior thereof; said top wall having a handle grip opening; retractable handle means assembled in the housing and having a handle grip extendable out of the handle grip opening in the top wall for carrying the unit in the collapsed configuration; a second removable wall for covering said display opening when said unit is in the collapsed configuration; means to releasably secure the second wall in covering relationship to said opening when the unit is in the collapsed configuration; and a stand releasably secured to the housing to support the housing when the unit is in the display configuration.

2. The portable display unit of claim 1 including: a restraining finger fixed to the top wall adjacent the opening thereof and being pivotally movable to a position in spanning relationship to said opening to prevent full retraction of the handle grip into the housing.

3. The portable display unit of claim 1 including: a cross beam located in the housing extended the length thereof in parallel relationship to the second wall when the second wall is in the collapsed configuration; said handle means being assembled to the cross beam, said cross beam having holding means for holding a display card with respect to the display opening when the first wall is removed from the housing.

4. The portable display unit of claim 3 including: a display frame surrounding the display opening, said means to hold a display card including a pair of holding arms pivotally connected to the cross beam and frictionally movable to position in contact with the inward surface of a display card when the display card has outer peripheral edges in contact with the inward surface of the frame.

5. The portable display unit of claim 3 wherein: the handle means includes a handle block, said handle grip fixed to the handle block, guide means fixed to the cross beam to guide up and down movement of the handle block and limit the amount of permissable upward movement of the handle block.

6. The portable display unit of claim 5 wherein: said guide means comprises inverted U-shaped members fixed to the cross beam, said handle block having ends extended through the inverted U-shaped members.

7. The portable display unit of claim 5 wherein: the means to releasably secure the second wall in covering relationship to the display opening comprises a pair of downwardly oriented hook-like members secured to the interior surface of the second wall toward the lower portion thereof for engagement with the upper edge of a lower horizontal member of the frame, and a pair of fasteners with rotatable arms fastened to the interior surface of the second wall toward the upper portion thereof for engagement with the inside surface of an upper horizontal frame member.

8. The portable display unit of claim 7 wherein: said housing has a third wall in parallel relationship to and spaced from the second wall and including means for storing the second wall adjacent the second wall when said unit is in the display configuration.

9. The portable display unit of claim 8 wherein: the means to store the second wall includes a pair of clip assemblies fixed to a bottom wall of the housing near the edge thereof adjacent the second wall, each clip assembly having a flat base and a free end comprised as a semicircular spring element, and a movable T-shaped support member with a flat body terminating in and outwardly directed lip at one end and outwardly directed arms at the other end assembled in the resilient spring elements; said T-shaped support member being rotatable from position under the bottom wall of the housing to at least partially support the lower edge of the first wall, said resilient spring elements comprising an over center spring clip tending to keep the support elements in either their retracted position under the bottom wall of the housing and the outwardly extended position to support the lower edge of the second wall.

10. The portable display unit of claim 1 wherein: said stand includes a column and a base, and means for releasably securing the column to the base.

11. The portable display unit of claim 11 wherein: said means for securing the column to the housing and the base comprises bayonet fastening means.

12. The portable display unit of claim 11 wherein: said housing has a third wall parallel to and spaced from the second wall, said third wall having an elongated door for insertion and removal of the column from the interior of the housing.

13. The portable display unit of claim 12 wherein: said door is horizontally pivotally about its lower edge between open and closed positions, said housing having a hasp assembly for securing the top wall and the horizontally pivotal door when the unit is in the collapsed configuration, said hasp assembly including a hinged strap assembled to the top wall, a hasp eye assembled to the second strap fixed to the horizontally pivotal door and positioned to engage the hasp eye when the door is pivoted to the closed position.

14. A portable display unit convertible between a portable collapsed configuration and a display configuration for exhibition of at least one display card, comprising: a housing having a first display opening for exhibition of a display card located in the housing when said unit is in the display configuration; holding means operably associated with the housing adapted to engage the display card adjacent said first display opening and retain said display card adjacent said first display opening; a first removable wall for covering said display opening when said unit is in the collapsed configuration; means to releasably secure the first wall to the housing in covering relationship to said opening when the display unit is in the collapsed configuration; said housing having a second display opening; a third removable wall for covering said second display opening; means to releasably secure the third wall in covering relationship to said second display opening when the unit is in the collapsed configuration; and a stand releasably securable to the housing to support the housing when the unit is in the display configuration.

15. The portable display unit of claim 14 including: means for storing the first and second walls in the housing when the unit is in the display configuration.

16. The portable display unit of claim 15 wherein: the first and second walls are parallel, spaced apart front and rear walls extending substantially the length of the housing when in the display configuration, and including third and fourth walls constituted as sidewalls, said sidewalls having vertical parallel interior grooves to accommodate the lateral edge portions of the first and second walls when the first and second walls are stored in the housing.

17. The portable display unit of claim 16 including: a bottom wall having a groove corresponding to the grooves in the sidewalls for accomodation of the lower edge portions of the first and second walls when stored in the housing.

18. A portable display unit convertible between a portable collapsed configuration and a display configuration for exhibition of at least one display card comprising: a housing having a first display opening and a second display opening for exhibition of a display card located in the housing when the unit is in the display configuration, a first removable wall for covering one display opening and a second removable wall for covering the second display opening, first means releasably securing the first wall to said housing in covering relationship with said first opening and second means releasably securing the second wall to said housing to cover said second opening, said housing having the top wall movable to a position to open the top of the housing to permit insertion and withdrawal of the first and second walls from within the housing.

19. The portable display unit of claim 18 wherein: the first and second removable walls are parallel, spaced apart front and rear walls extended substantially the length of the housing when in display configuration and including side walls having generally vertical interior grooves to accommodate lateral edge portions of the front and rear walls when the front and rear walls are stored in the housing, said side walls having upper sections including pivoting block means pivotal from position in engagement with front and rear wall edges to a position clear of the front and rear wall edges so that the front and rear walls can be inserted and removed from within the housing, said block means having a covering to cover the tops of the grooves in said side walls.

20. The portable display unit of claim 16 wherein: said top wall has a handle grip opening; retractable handle means assembled in the housing and having a handle extendable out of the handle grip opening in the top wall for carrying the unit in the collapsed configuration.

21. The portable display unit of claim 20 wherein: said first and second walls are front and rear walls and including a cross beam located in the housing extended the length thereof in parallel relationship to the first wall in the collapsed configuration; said handle means being assembled to the cross beam, said cross beam having first holding means for holding a display card with respect to the first display opening when the first wall is removed from the housing.

22. The portable display unit of claim 21 wherein: the second wall is storable in the housing between the first wall and the second display opening in the display configuration, said second wall carrying second holding means for holding a display card with respect to the second display opening in the display configuration.

23. The portable display unit of claim 22 including: a first frame surrounding the first display opening, said first holding means to hold a display card with respect to the first display opening including a pair of holding arms pivotally connected to the cross beam and frictionally movable to position in contact with the inward surface of a display card when the display card has outer peripheral edges in contact with the inward surface of the first frame.

24. The portable display unit of claim 23 including: a second frame surrounding the second display opening, said second holding means to hold a display card with respect to the second display opening including a pair of holding arms pivotally connected to the second wall and movable to position in contact with the inward surface of a display card when the display card has outer peripheral edges in contact with the inward surface of the second frame when the second wall is in the display configuration.

25. The portable display unit of claim 21 wherein: the handle means includes a handle block, and a handle grip fixed to the handle block, guide means fixed to the cross beam to guide up and down movement of the handle block and limit the amount of permissible upward movement of the handle block.

26. The portable display unit of claim 25 wherein: said guide means comprises inverted U-shaped members fixed to the cross beam, said handle block having ends extended through the inverted U-shaped members.

27. The portable display unit of claim 18 wherein: the first means to releasably secure the first wall in covering relationship to the first display opening comprises a pair of downwardly oriented hook-like members secured to the interior surface of the first wall toward the lower portion thereof for engagement with the upper edge of the lower horizontal member of the first frame, and a first pair of wing-type fasteners with rotatable arms fastened to the interior surface of the first wall toward the upper portion thereof for engagement with the inside surface of the upper horizontal member of the first frame.

28. The portable display unit of claim 27 wherein: the second means to releasably secure the second wall in covering relationship to the second display opening comprises a second pair of downwardly oriented hook-like members secured to the interior surface of the second wall toward the lower portion thereof for engagement with the upper edge of the lower horizontal member of the second frame, and a second pair of wing-type fasteners with rotatable arms fastened to the interior surface of the second wall toward the upper portion thereof for engagement with the inside surface of a upper horizontal member of the second frame.

29. The portable display unit of claim 26 wherein: the first and second walls extend substantially the length of the housing when in the display configuration, and including third and fourth walls constituted as sidewalls, said sidewalls having vertical parallel interior grooves to accomodate the lateral edge portions of the first and second walls when the first and second walls are stored in the housing.

30. The portable display unit of claim 29 including: a bottom wall having a groove corresponding to the grooves in the sidewalls for accomodation of the lower edge portions of the first and second walls when stored in the housing.

31. The portable display unit of claim 30 wherein: the upper sections of each of the sidewalls is comprised as a pivoting block pivotal from position in engagement with the first and second wall edges to a position clear of the first and second wall edges so that the first and second walls can be inserted and removed from within the housing, said blocks having a covering to cover the tops of the grooves in said sidewalls.

32. The portable display unit of claim 31 including: latch means to latch the pivoting blocks in position in engagement with the side wall edges.

33. A portable display unit convertible between a portable collapsed configuration and a display configuration for exhibition of at least one display card, comprising: a housing having a display opening for exhibition of a display card located in the housing when said unit is in the display configuration, a stand releasably securable to the housing to support the housing when the display unit is in the display configuration, said housing having a chamber of a size to accommodate said stand when the stand is released from the housing, a first removable wall for covering said display opening when said unit is in the collapsed configuration, and means to releasably secure the wall to the housing in covering relationship to said opening when the unit is in the collapsed configuration.

34. A portable display unit convertible between a portable collapsed configuration and a display configuration for exhibition of at least one display card, comprising: a housing having a frame surrounding said display opening, said frame having an inside surface, holding means adapted to hold a display card in engagement with the inside surface of the frame; a first removable wall for covering said display opening when said unit is in a collapsed configuration; means to releasably secure the first wall to the housing in covering relationship to said opening when the unit is in the collapsed configuration; and a stand releasably securable to the housing to support the housing when the unit is in the display configuration.

35. The portable display unit of claim 34 including: a cross beam located in the housing extended the length thereof in general parallel relationship to the first removable wall when said first wall is in the collapsed configuration.

36. The portable display unit of claim 35 wherein: said holding means comprise means movably mounted on said cross beam and engageable with said display card to hold said display card in engagement with the inside surface of the frame.

37. The portable display unit of claim 34 wheren: said holding means comprise a plurality of members movably associated with said frame and engageable with a display card to hold said display card in engagement with the inside surface of the frame.

38. The portable display unit of claim 34 wherein: said housing has a top wall movable to a position to open the top of the housing whereby said display card and first wall can be selectively inserted and withdrawn from within said housing.

39. The portable display unit of claim 34 wherein: said stand includes a column and a base, and means for releasably securing the column to the housing and to the base.

40. The portable display unit of claim 39 wherein: said means for securing the column to the housing and the base comprises bayonet fastening means.

41. The portable display unit of claim 34, including: a cross beam secured to said housing and located within said housing, said holding means including a plurality of holding arms pivotally connected to said cross beam and movable to positions in contact with said display card to hold the display card in engagement with the inside surface of the frame.

42. The portable display unit of claim 34 wherein: said frame has a second display opening, a second removable wall for covering said second display opening, and means to releasably mount the second wall on the housing in covering relationship to said second opening when the unit is in the collapsed configuration.

43. The portable display unit of claim 42 wherein: said housing has a chamber for storing the first and second walls when the unit is in a display configuration.

44. The portable display unit of claim 43 wherein: said housing has a top opening and a top wall for closing said top opening, said top wall being movable to a position to open the top opening of said housing whereby said first and second walls and display card can be selectively inserted and withdrawn from within the housing.

45. A portable display unit convertible between a portable collapsed configuration and a display configuration for exhibition of at least one display card, comprising: a housing having a chamber and frame means surrounding a display opening for exhibition of a display card, said frame means having an inside surface, said display card being locatable in said chamber in engagement with said inside surface closing said display opening, holding means secured to the housing located in the chamber adapted to hold the display card in engagement with the inside surface of the frame means, said holding means comprising a plurality of members movably associated with said housing and engageable with the display card to hold said display card in engagement with the inside surface of the frame means, and stand means releasably securable to the housing to support the housing when the unit is in the display configuration.

46. The portable display unit of claim 45 wherein: the housing has a bottom wall, side walls and an open top, said frame means being connected to said bottom wall and side walls, means for closing the open top of the housing, and means releasably connecting the stand means to said bottom wall.

47. The portable display unit of claim 46 wherein: the means releasably connecting the stand means to said bottom wall comprise bayonet fastening means.

48. The portable display unit of claim 45 wherein: said frame means includes a generally rectangular lip surrounding said display opening, said lip having said inside surface.

49. The portable display unit of claim 45 including: a cross beam located in the chamber behind said display opening, said cross being being secured to said housing.

50. The portable display unit of claim 49 wherein: said members of the holding means are movably mounted on said cross beam and engageable with said display card to hold said display card in engagement with the inside surface of the frame means.

51. The portable display unit of claim 45 wherein: said housing has a top opening and a top wall for closing said top opening, said top wall being movable to a position to open the top opening of the housing whereby said display card can be selectively inserted and withdrawn from said chamber.

52. The portable display unit of claim 45 wherein: said stand means includes a column and a base, and means for releasably securing the column to the base.

53. The portable display unit of claim 52 wherein: said means for securing the column to the base comprises bayonet fastening means.

54. The portable display unit of claim 45 wherein: said frame means has a second display opening and a second inside surface adapted to engage a second display card and second holding means secured to the housing adapted to hold the second display card in engagement with the second inside surface.

55. The portable display unit of claim 54 wherein: said housing has a top opening and a top wall closing the top opening, said top wall being movable to a position to open the top opening of said housing whereby said display cards can be inserted and withdrawn from the chamber.

* * * * *

UNITED STATES PATENT AND TRADEMARK OFFICE

CERTIFICATE OF CORRECTION

PATENT NO. : 4,322,905

DATED : April 6, 1982

INVENTOR(S) : Robert A. Kruse

It is certified that error appears in the above-identified patent and that said Letters Patent is hereby corrected as shown below:

Column 15, line 11, "being" (first occurrence) should be -- beam --.

Column 6, line 6, "116" should be -- 106 --.

Column 10, line 53, "11" should be -- 10 --.

Column 13, line 9, "26" should be -- 24 --.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*